US010577864B2

(12) United States Patent
Gillis

(10) Patent No.: US 10,577,864 B2
(45) Date of Patent: Mar. 3, 2020

(54) METHOD AND SYSTEM FOR DRILLING A BOREHOLE

(71) Applicant: IGGILLIS HOLDINGS INC., Edmonton (CA)

(72) Inventor: Ian G. Gillis, Didsbury (CA)

( * ) Notice: Subject to any disclaimer, the term of this patent is extended or adjusted under 35 U.S.C. 154(b) by 414 days.

(21) Appl. No.: 15/321,531

(22) PCT Filed: Jun. 23, 2015

(86) PCT No.: PCT/CA2015/000410
§ 371 (c)(1),
(2) Date: Dec. 22, 2016

(87) PCT Pub. No.: WO2015/196274
PCT Pub. Date: Dec. 30, 2015

(65) Prior Publication Data

US 2017/0211329 A1 Jul. 27, 2017

Related U.S. Application Data

(60) Provisional application No. 62/016,197, filed on Jun. 24, 2014.

(51) Int. Cl.
*E21B 7/06* (2006.01)
*E21B 3/00* (2006.01)
*E21B 47/024* (2006.01)

(52) U.S. Cl.
CPC ..... *E21B 7/06* (2013.01); *E21B 3/00* (2013.01); *E21B 7/067* (2013.01); *E21B 7/068* (2013.01); *E21B 47/024* (2013.01)

(58) Field of Classification Search
CPC . E21B 7/06; E21B 3/00; E21B 47/024; E21B 7/067; E21B 7/068
See application file for complete search history.

(56) References Cited

U.S. PATENT DOCUMENTS

| | | | |
|---|---|---|---|
| 6,050,348 | A | 4/2000 | Richarson et al. |
| 7,096,979 | B2 | 8/2006 | Haci et al. |
| 7,404,454 | B2 | 7/2008 | Hulick |
| 7,588,100 | B2 | 9/2009 | Hamilton |
| 7,802,634 | B2 | 9/2010 | Boone |

(Continued)

OTHER PUBLICATIONS

Canrig Drilling Technology Ltd., Brochure entitled "Drilling Performance Services", undated (6 pages).

(Continued)

*Primary Examiner* — Brad Harcourt
(74) *Attorney, Agent, or Firm* — Terrence N. Kuharchuk; Rodman & Rodman LLP

(57) ABSTRACT

A method of drilling a borehole from a surface location with a drill string, and a system for implementing the method are provided. The method includes a rotary mode that involves rotating the drill string at a rotary mode rotation rate in order to drill the borehole for a rotary interval, an orientation mode that involves rotating the drill string at an orientation mode rotation rate and transitioning the rotation of the drill string from the orientation mode rotation rate to a surface stop orientation, and maintaining the drill string at a surface fixed orientation in order to drill the borehole in a directional mode for a directional interval. The surface stop orientation is selected based upon a predicted relationship between the surface stop orientation and a toolface stop orientation.

43 Claims, 11 Drawing Sheets

(56) References Cited

U.S. PATENT DOCUMENTS

| | | | |
|---|---|---|---|
| 7,823,655 | B2 | 11/2010 | Boone et al. |
| 8,360,171 | B2 | 1/2013 | Boone et al. |
| 8,528,663 | B2 | 9/2013 | Boone |
| 8,602,126 | B2 | 12/2013 | Boone et al. |
| 2002/0104685 | A1 | 8/2002 | Pinckard et al. |
| 2008/0066958 | A1 | 3/2008 | Haci et al. |
| 2013/0032401 | A1 | 2/2013 | Edbury et al. |
| 2013/0161096 | A1 | 6/2013 | Benson et al. |
| 2014/0166363 | A1 | 6/2014 | Haci et al. |

OTHER PUBLICATIONS

Schlumberger, Brochure entitled "Slider Plus—Fully Automated Slide Drilling System", 2013 (2 pages).

| DEPTH (m) | QUILL COMMAND | DRILL STRING STATUS | DRILLING MODE | RPM | DIFFERENTIAL PRESSURE | DESIRED TOOLFACE | QUILL REFERENCE | TOOLFACE REFERENCE | DELTA (QUILL) TO DESIRED TOOLFACE | ACTUAL QUILL STOP | ACTUAL TOOLFACE STOP | TOOLFACE ERROR |
|---|---|---|---|---|---|---|---|---|---|---|---|---|
| | | | | | | | | | | | | |
| 0 m | Implement Rotary Mode Rotation | First Rotating State | Rotary Mode | Ramp Up To 45 RPM in 4 Seconds | | 60 | N/A | N/A | N/A | N/A | N/A | N/A |
| 0-0.9 m | N/A | First Rotating State | Rotary Mode | 45 RPM | | 60 | N/A | N/A | N/A | N/A | N/A | N/A |
| 0.9 m | Implement Orientation Mode Rotation | Second Rotating State | Orientation Mode | Slow Rotation To 20 RPM in 2 Seconds | Drill-Off To 200 psi | 60 | 60 | 30 | 30 | N/A | N/A | N/A |
| 1 m | Stop Rotation | Non-Rotating State | Orientation Mode | Ramp Down To 0 RPM in 6 Seconds And 360 Degrees | 200 psi | 60 | N/A | N/A | N/A | 110 | 60 | 0 |
| 1m | Counter-Rotate | Counter-Rotating State | Orientation Mode | N/A | 200 psi | 60 | N/A | N/A | N/A | 110-(Counter-Rotation) | 60 | 0 |
| 1m-2m | N/A | Non-Rotating State | Directional Mode | 0 | 200 psi | 60 | N/A | N/A | N/A | 110-(Counter-Rotation) | Ongoing Measurement | Variable |
| 2 m | Implement Rotary Mode Rotation | First Rotating State | Rotary Mode | Ramp Up To 45 RPM in 4 seconds | Increase To | 60 | N/A | N/A | NA | N/A | N/A | N/A |
| 2-2.9 m | N/A | First Rotating State | Rotary Mode | 45 RPM | | 60 | N/A | N/A | N/A | N/A | N/A | N/A |
| 2.9 m | Implement Orientation Mode Rotation | Second Rotating State | Orientation Mode | Slow Rotation To 20 RPM in 2 Seconds | Drill-Off To 200 psi | 60 | 310 | 85 | -25 | N/A | N/A | N/A |

Figure 8

| DEPTH (m) | QUILL COMMAND | DRILL STRING STATUS | DRILLING MODE | RPM | DIFFERENTIAL PRESSURE | DESIRED TOOLFACE | QUILL REFERENCE | TOOLFACE REFERENCE | DELTA (QUILL) TO DESIRED TOOLFACE | ACTUAL QUILL STOP | ACTUAL TOOLFACE STOP | TOOLFACE ERROR |
|---|---|---|---|---|---|---|---|---|---|---|---|---|
| 3 m | Stop Rotation | Non-Rotating State | Orientation Mode | Ramp Down To 0 RPM In 6 Seconds And 360 Degrees | 200 psi | 60 | N/A | N/A | N/A | 285 | 82 | 22 |
| 3.1 m | Implement Orientation Mode Rotation | Second Rotating State | Orientation Mode | Increase Rotation To 20 RPM In 3 Seconds | 200 psi | 60 | 210 | 110 | -50 | N/A | N/A | N/A |
| 3.2 m | Stop Rotation | Non-Rotating State | Orientation Mode | Ramp Down To 0 RPM In 6 Seconds And 360 Degrees | 200 psi | 60 | N/A | N/A | N/A | 160 | 60 | 0 |
| 3.2 m | Counter-Rotate | Counter-Rotating State | Orientation Mode | N/A | 200 psi | 60 | N/A | N/A | N/A | 160-(Counter-Rotation) | 60 | 0 |
| 3.2-4 m | N/A | Non-Rotating State | Directional Mode | 0 | 200 psi | 60 | N/A | N/A | N/A | 160-(Counter-Rotation) | Ongoing Measurement | Variable |
| 4 m | Implement Rotary Mode Rotation | First Rotating State | Rotary Mode | Ramp Up To 45 RPM In 4 Seconds | Increase To | 60 | N/A | N/A | N/A | N/A | N/A | N/A |

Figure 8 (continued)

| ORIENTATION MODE ROTATION SPEED | RAMP DOWN (TRANSITION) PARAMETERS | | | | COUNTER-ROTATION PARAMETERS | | | |
|---|---|---|---|---|---|---|---|---|
| RPM | Degrees | | Time (Seconds) | | Torque | | Time (Seconds) | |
| | Min | Max | Min | Max | Min | Max | Min | Max |
| | | | | | | | | |
| 45 | 30 | 600 | 1 | 15 | -50% Of Make-Up Torque | Motor Torque | 1 | 15 |
| | | | | | | | | |
| 25 | 30 | 600 | 1 | 15 | -50% Of Make-Up Torque | Motor torque | 1 | 15 |
| | | | | | | | | |
| 20 | 30 | 500 | 1 | 10 | -50% Of Make-Up Torque | Motor torque | 1 | 10 |
| | | | | | | | | |
| 15 | 30 | 400 | 1 | 5 | -50% Of Make-Up Torque | Motor torque | 1 | 5 |
| | | | | | | | | |
| 10 | 30 | 300 | 1 | 4 | -50% Of Make-Up Torque | Motor torque | 1 | 4 |
| | | | | | | | | |
| 5 | 30 | 200 | 1 | 3 | -50% Of Make-Up Torque | Motor torque | 1 | 3 |

Figure 9

| DEFAULT QUILL RAMP DOWN (TRANSITION) PARAMETERS: QUILL STOP TIME = 6 SECONDS; QUILL STOP ANGLE = 360 DEGREES DEFAULT COUNTER-ROTATION ANGLE = ??? DEGREES | TOOLFACE RAMP DOWN (TRANSITION) RESPONSE | RESULTING TOOLFACE ERROR | POSSIBLE MODIFICATION TO RAMP DOWN (TRANSITION) PARAMETERS | POSSIBLE MODIFICATION TO COUNTER-ROTATION PARAMETERS | NOTES |
|---|---|---|---|---|---|
| FLAG 1 | Toolface Stop Time > 6 Seconds; Toolface Stop Angle > 360 Degrees | Positive Error: Toolface Moves > 360 Degrees | Increase Quill Stop Angle To > 360 Degrees | | Suggests Momentum Of Pipe AND Release Of Reactive Torque |
| | Toolface Stop Time > 6 Seconds; Toolface Stop Angle > 360 Degrees | Negative Error: Toolface Moves < 360 Degrees | Increase Quill Stop Angle To > 360 Degrees | Decrease Counter-Rotation Angle To < ??? Degrees | Suggests Release Of Reactive Torque |
| FLAG 2 | Toolface Stop Time > 6 Seconds; Toolface Stop Angle < 360 Degrees | Positive Error: Toolface Moves > 360 Degrees | Decrease Quill Stop Time To < 6 Seconds | | Suggests Stick-Slip During Drilling |
| | Toolface Stop Time > 6 Seconds; Toolface Stop Angle < 360 Degrees | Negative Error: Toolface Moves < 360 Degrees | Decrease Quill Stop Time To < 6 Seconds | Decrease Counter-Rotation Angle To < ??? Degrees | Suggests Overshoot AND Backlash |
| FLAG 3 | Toolface Stop Time < 6 Seconds; Toolface Stop Angle > 360 Degrees | Positive Error: Toolface Moves > 360 Degrees | Increase Quill Stop Angle To > 360 Degrees | | Suggests Stick-Slip During Drilling |
| | Toolface Stop Time < 6 Seconds; Toolface Stop Angle > 360 Degrees | Negative Error: Toolface Moves < 360 Degrees | Decrease Quill Stop Time To < 6 Seconds | Increase Counter-Rotation Angle To > ??? Degrees | Suggests Backlash |
| FLAG 4 | Toolface Stop Time < 6 Seconds; Toolface Stop Angle < 360 Degrees | Positive Error: Toolface Moves > 360 Degrees | Decrease Quill Stop Angle To < 360 Degrees | Increase Counter-Rotation Angle To > ??? Degrees | Suggests High Wellbore Friction AND Release Of Reactive Torque |
| | Toolface Stop Time < 6 Seconds; Toolface Stop Angle < 360 Degrees | Negative Error: Toolface Moves < 360 Degrees | Decrease Quill Stop Angle To < 360 Degrees | | Suggests High Wellbore Friction |

Figure 10

METHOD AND SYSTEM FOR DRILLING A BOREHOLE

TECHNICAL FIELD

A method and system for drilling a borehole from a surface location using a combination of rotary intervals and directional intervals.

BACKGROUND OF THE INVENTION

In drilling a borehole, it may be advantageous to control the direction of drilling. For example, a typical borehole may include a substantially vertical section, a lateral section which may be slanted or substantially horizontal, and a curve section which connects the vertical section and the lateral section. Drilling a borehole while controlling the direction of drilling is referred to as directional drilling. Directional drilling involves orienting a drill bit in a direction (i.e., a toolface orientation) which facilitates drilling in a desired direction.

Drilling a borehole may be performed using various methods, including by rotary drilling, by non-rotary (i.e., "sliding") drilling, and by a combination of rotary and non-rotary drilling. In rotary drilling, the drill string is typically rotated from a surface location in order to rotate a drill bit which is connected to the distal end of the drill string. In non-rotary drilling, the drill bit is not rotated with the drill string from the surface location, but is either rotated, reciprocated or otherwise driven by a downhole drilling motor which is connected within the drill string and is also connected with the drill bit. In a combination of rotary and non-rotary drilling, the drill bit may be rotated by rotating the drill string from the surface location and may be simultaneously driven by a downhole drilling motor.

Directional control during rotary drilling may be achieved with a rotary steerable drilling device which is capable of providing a toolface orientation. Directional control during non-rotary drilling may be achieved with a bent drilling motor or a bent sub which is capable of providing a toolface orientation.

Drilling rates are typically greater during rotary drilling than during directional drilling. As a result, directional drilling using a rotary steerable drilling device may potentially offer faster drilling performance than directional drilling using non-rotary drilling techniques. The continuous rotation and directional control provided by a rotary steerable drilling device may also result in a smoother borehole. Unfortunately, rotary steerable drilling devices tend to be expensive and relatively complex.

As a result, there remains a need for drilling methods which utilize both rotary drilling and non-rotary drilling in order to achieve directional control over a wellbore as it is drilled. There also remains a need for drilling methods in which transitions between rotary drilling and non-rotary drilling can be achieved relatively simply and quickly.

SUMMARY OF THE INVENTION

References in this document to orientations, to operating parameters, to ranges, to lower limits of ranges, and to upper limits of ranges are not intended to provide strict boundaries for the scope of the invention, but should be construed to mean "approximately" or "about" or "substantially", within the scope of the teachings of this document, unless expressly stated otherwise.

The present invention is directed at a method and a system for use in drilling a borehole from a surface location using a drill string, using a combination of rotary drilling and non-rotary drilling.

In this document, "proximal" means located relatively toward an intended "uphole" end, "upper" end and/or "surface" end of a borehole or of a drill string in the borehole. In this document, "distal" means located relatively away from an intended "uphole" end, "upper" end and/or "surface" end of a borehole or of a drill string in the borehole.

The drill string may be comprised of a plurality of pipe joints or any other suitable elongated structure connected together. A drill bit is attached to a distal end of the drill string, and one or more drilling motors may be connected within the drill string and connected with the drill bit. The drill bit is capable of being oriented at a desired toolface orientation. The one or more drilling motors may be comprised of any device or combination of devices which are suitable for driving the drill bit, including as non-limiting examples, a progressive cavity motor (PCM), a turbine, a reciprocating motor, etc.

In some embodiments, the method may be comprised of drilling the borehole in a rotary mode for a rotary interval by rotary drilling, and drilling the borehole in a directional mode for a directional interval by non-rotary drilling. In some embodiments, the method may be comprised of alternating the rotary mode and the directional mode in order to drill the borehole with alternating rotary intervals and directional intervals.

In some embodiments, the method may be comprised of three different drilling modes—a rotary mode, an orientation mode, and a directional mode—that are associated with at least three different "rotation states" of the drill string—a first rotating state, a second rotating state, and a non-rotating state. In some embodiments, the method may be further comprised of a counter-rotation mode associated with a counter-rotation state, a co-rotating state, or both a counter-rotation state and a co-rotating state of the drill string.

In the rotary mode associated with the first rotating state, the drill string is rotated at a rotary mode rotation rate in order to drill a rotary interval of the borehole. A purpose of the first rotating state is to perform rotary drilling. As a result, in the first rotating state, the rotary mode rotation rate may be selected to optimize rotary drilling. The rotary mode rotation rate may be relatively constant or may fluctuate during the rotary interval of the borehole.

In the orientation mode associated with the second rotating state, the drill string is rotated at an orientation mode rotation rate in order to facilitate orienting the drill bit in a desired toolface orientation. A purpose of the second rotating state is to provide a steady state rotation of the drill string which will facilitate orienting the drill bit at a desired toolface orientation. In some embodiments, a steady state rotation of the drill string may be achieved while in the first rotating state. As a result, in some embodiments, the second rotating state may occur while rotating the drill string at the rotary mode rotation rate, so that the orientation mode rotation rate is the same as the rotary mode orientation rate. In other embodiments, particularly if the rotary mode rotation rate is fluctuating during rotary drilling, the second rotating state may be implemented by altering the rotation of the drill string from the first rotating state to the second rotating state, such as by maintaining a constant rotation rate and/or by changing the rotation rate in order to achieve a steady state rotation of the drill string.

In the directional mode associated with the non-rotating state, a directional interval of the borehole is drilled without rotating the drill string. A purpose of the non-rotating state is to perform non-rotary drilling in the directional mode. As a result, in the non-rotating state, the drill string may be maintained at a surface fixed orientation in order to provide a desired toolface orientation to facilitate directional drilling.

In the counter-rotation mode associated with the counter-rotation state and/or the co-rotation state, the drill string is counter-rotated, or co-rotated, or both counter-rotated and co-rotated. In this document, "counter-rotating" the drill string means that the drill string is rotated in the direction opposite to the rotation direction of the drill bit during rotary drilling. In this document, "co-rotating" the drill string means that the drill string is rotated in the rotation direction of the drill bit during rotary drilling.

A purpose of the counter-rotation state may be to release torque within the drill string which has resulted from rotary mode drilling. Another purpose of the counter-rotation state may be to balance the torque within the drill string with the torque which is expected during directional mode drilling so that the torque within the drill string is relatively consistent and constant along the length of the drill string during directional mode drilling. Releasing and/or balancing torque within the drill string may assist in maintaining the desired toolface orientation during directional mode drilling, by reducing unbalanced torsional stress on the drill string which may tend to rotate the toolface to the right or to the left.

In some embodiments, the counter-rotation state may comprise counter-rotating the drill string from the non-rotating state in a counter-rotating mode by an amount in order to release torque from the drill string resulting from rotary mode drilling. In some embodiments, the amount of counter-rotation may be selected to provide a desired amount of residual torque in the drill string at the surface location. In some embodiments, the desired amount of residual torque may be less than or equal to an expected torque within the drill string during directional mode drilling. In some embodiments, the desired amount of residual torque may be substantially zero. In some embodiments, the desired amount of residual torque may be a negative torque. In some embodiments in which the desired amount of residual torque is a negative torque, the maximum amount of negative torque may be limited by the strength of the connections between pipe joints in the drill string (i.e., the make-up torque). In some embodiments, the maximum amount of negative torque may be approximately 50 percent of the make-up torque.

In some embodiments, the counter-rotation state may comprise co-rotating the drill string in order to balance the torque within the drill string with the torque which is expected during directional mode drilling. In some embodiments, the amount of co-rotation may be selected to provide a desired amount of balance torque in the drill string at the surface location. In some embodiments, the desired amount of balance torque may be approximately equal to the expected torque in the drill string during directional mode drilling.

In some embodiments, it may not be necessary or desirable for the counter-rotation state to include both counter-rotating and co-rotating the drill string. For example, in some embodiments, balancing of the torque within the drill string may be achieved solely by either counter-rotating or co-rotating the drill string.

As a result, in some embodiments in which the method is comprised of a counter-rotation state, the counter-rotation state may comprise only counter-rotating or co-rotating the drill string in order to release torque from the drill string. In some embodiments in which the method is comprised of a counter-rotation state, the counter-rotation state may comprise counter-rotating the drill string in order to release torque from the drill string resulting from rotary mode drilling, followed by co-rotating the drill string in order to balance the torque within the drill string with the torque which is expected during directional mode drilling.

In some embodiments, the counter-rotation state is performed in a manner such that the toolface orientation does not change during the counter-rotation state. In some embodiments, the toolface orientation may be adjusted following the performance of the counter-rotation state in order to account for any change in toolface orientation which may occur in the counter-rotation state.

In one aspect, the invention is directed at a method of drilling a borehole from a surface location with a drill string comprising a surface end having a surface orientation and a distal end having a toolface orientation, the method comprising:

(a) a rotary mode comprising rotating the drill string at a rotary mode rotation rate in order to drill the borehole for a rotary interval;
(b) an orientation mode comprising:
  (i) rotating the drill string at an orientation mode rotation rate;
  (ii) transitioning the rotation of the drill string from the orientation mode rotation rate to a non-rotating state in which the surface orientation is at a surface stop orientation; and
(c) a directional mode comprising maintaining the surface orientation at a surface fixed orientation in order to drill the borehole for a directional interval.

In some embodiments, the method may be comprised of repeating any one or a combination of the rotary mode, the orientation mode and the directional mode one or more times in order to drill the borehole with alternating rotary intervals and directional intervals.

In some embodiments, the rotary mode, the orientation mode and the directional mode may be implemented within a length of a single joint of drill pipe added to the drill string.

The toolface orientation may be at a toolface stop orientation when the surface orientation is at the surface stop orientation. A desired toolface stop orientation and/or a desired toolface stop orientation range may be associated with the surface stop orientation and/or the toolface stop orientation. In some embodiments, the surface stop orientation may be selected based upon a predicted relationship between the surface stop orientation and the toolface stop orientation.

The toolface orientation may be at a toolface fixed orientation when the surface orientation is at the surface fixed orientation. A desired toolface fixed orientation and/or a desired toolface fixed orientation range may be associated with the surface fixed orientation and/or the toolface fixed orientation. In some embodiments, the surface fixed orientation may be selected based upon a predicted relationship between the surface fixed orientation and the toolface fixed orientation. In some embodiments, the surface stop orientation may be selected based upon a predicted relationship amongst the surface stop orientation, the surface fixed orientation, the toolface stop orientation, and the toolface fixed orientation.

The surface fixed orientation may be the same as the surface stop orientation or may be different from the surface stop orientation. The toolface fixed orientation may be the same as the toolface stop orientation or may be different from the toolface stop orientation. The desired toolface fixed orientation may be the same as the desired toolface stop orientation or may be different from the desired toolface stop orientation. The desired toolface fixed orientation range may be the same as the desired toolface stop orientation range or may be different from the desired toolface stop orientation range.

In some embodiments, the method may be comprised of a counter-rotation mode comprising either counter-rotating or co-rotating, or both counter-rotating and co-rotating the drill string from the surface stop orientation to the surface fixed orientation.

In some embodiments, the counter-rotation mode may be performed in order to release torque from the drill string. In some embodiments, the torque may be released to achieve a desired residual torque in the drill string at the surface location.

In some embodiments, the counter-rotation mode may be performed in order to achieve a desired balance torque along the length of the drill string. In some embodiments, the desired balance torque may be approximately equal to an expected torque in the drill string during the directional mode.

In some embodiments, the method may be comprised of repeating the orientation mode if the toolface stop orientation is not within the desired toolface stop orientation range. In some embodiments, the method may be comprised of applying a correction factor to the surface stop orientation, before repeating transitioning the rotation of the drill string to the orientation mode rotation rate to the non-rotating state, wherein the correction factor is predicted to result in the toolface stop orientation being within the desired toolface stop orientation range.

In some embodiments, transitioning the rotation of the drill string from the orientation mode rotation rate to the surface stop orientation may be performed in accordance with transition parameters. In some embodiments, the method may be comprised of repeating the orientation mode if the toolface stop orientation is not within the desired toolface orientation range, and modifying the transition parameters if the toolface stop orientation is not within the desired toolface stop orientation range, before repeating transitioning the rotation of the drill string from the orientation mode rotation rate to the non-rotating state, wherein the modified transition parameters are predicted to result in the toolface stop orientation being within the desired toolface stop orientation range.

In some embodiments, the selected surface stop orientation may take into account a predicted movement of the toolface orientation during the counter-rotation mode such that the surface fixed orientation is predicted to result in the toolface orientation being at a toolface fixed orientation that is within a desired toolface fixed orientation range.

In some embodiments, the method may be comprised of repeating the counter-rotation mode if the toolface fixed orientation is not within a desired toolface fixed orientation range.

In some embodiments, the counter-rotation mode may be performed in accordance with counter-rotation parameters, and the method may be comprised of modifying the counter-rotation parameters if the toolface fixed orientation is not within the desired toolface fixed orientation range, before repeating the counter-rotation mode, wherein the modified counter-rotation parameters are predicted to result in the toolface fixed orientation being within the desired toolface fixed orientation range.

A differential pressure through the drill string may represent a difference between the pressure through the drill string when the drill bit is "on bottom" and the pressure through the drill string when the drill bit is "off bottom". The differential pressure is dependent at least in part upon the force exerted by the drill bit against the bottom of the borehole.

In some embodiments, the method may be comprised of achieving a desired differential pressure of a fluid circulating through the drill string before transitioning the rotation of the drill string from the orientation mode rotation rate to the non-rotating state. In some embodiments, the desired differential pressure may be achieved by allowing drill-off of the drill string while rotating the drill string at the orientation mode rotation rate.

In some embodiments, as the drill string is rotated at the orientation mode rotation rate, the surface orientation has a surface reference orientation and the toolface orientation has a toolface reference orientation, and the method may be comprised of determining a relationship between the toolface reference orientation and the surface reference orientation, and selecting the surface stop orientation based on the relationship. In some embodiments, the surface reference orientation and the toolface reference orientation may be determined at a plurality of coincident time intervals over a time period. In some embodiments, the surface reference orientation and the toolface reference orientation may be averaged over the time period.

In another aspect, the present invention is directed at a system for drilling a borehole from a surface location using a drill string, using a combination of rotary drilling and non-rotary drilling. The system comprises a processor and a set of instructions stored in a non-transitory storage media, wherein the processor is capable of reading the set of instructions and responsive thereto to implement a method of drilling a borehole from a surface location with a drill string as described above.

In some embodiments, the processor may be connected to an encoder to receive surface orientation data indicative of a surface orientation of a surface end of the drill string, a downhole instrument to receive toolface orientation data indicative of a toolface orientation of a distal end of the drill string, and a rotary drive to control the rotation of the drill string. In some embodiments, the downhole instrument comprises a measurement while drilling (MWD) tool that comprises an accelerometer to determine the toolface orientation. In this document, "rotary drive" means any type of mechanical device that can be used to apply a torque to a drill string to rotate the drill string to facilitate rotary drilling of a borehole, and in some embodiments, may include a top drive or a rotary table. In some embodiments, the system may be located at the surface, in the downhole environment, or a combination of the surface and the downhole environment, and may be located remotely from the borehole location.

In some embodiments, the computer comprises at least one timing clock for setting time intervals at which a surface reference orientation of the surface end of the drill string and a toolface reference orientation of the distal end of the drill string are determined.

BRIEF DESCRIPTION OF DRAWINGS

Embodiments of the invention will now be described with reference to the accompanying drawings, in which:

FIG. 8 is a table illustrating a hypothetical exemplary drilling sequence in accordance with a non-limiting implementation of the invention.

FIG. 9 is a table providing exemplary ranges for ramp down (transition) parameters during performance of the orientation mode and counter-rotation parameters during performance of the counter-rotation mode in accordance with a non-limiting implementation of the invention.

FIG. 10 is a table providing exemplary possible modifications to ramp down (transition) parameters during performance of the orientation mode and counter-rotation parameters during performance of the counter-rotation mode as consequences of possible events occurring during performance of the orientation mode and counter-rotation mode in accordance with a non-limiting implementation of the invention.

DETAILED DESCRIPTION

FIGS. 1-10 depict aspects of non-limiting embodiments of a method and a system for drilling a borehole from a surface location using a combination of rotary intervals and directional intervals.

Figure 1:
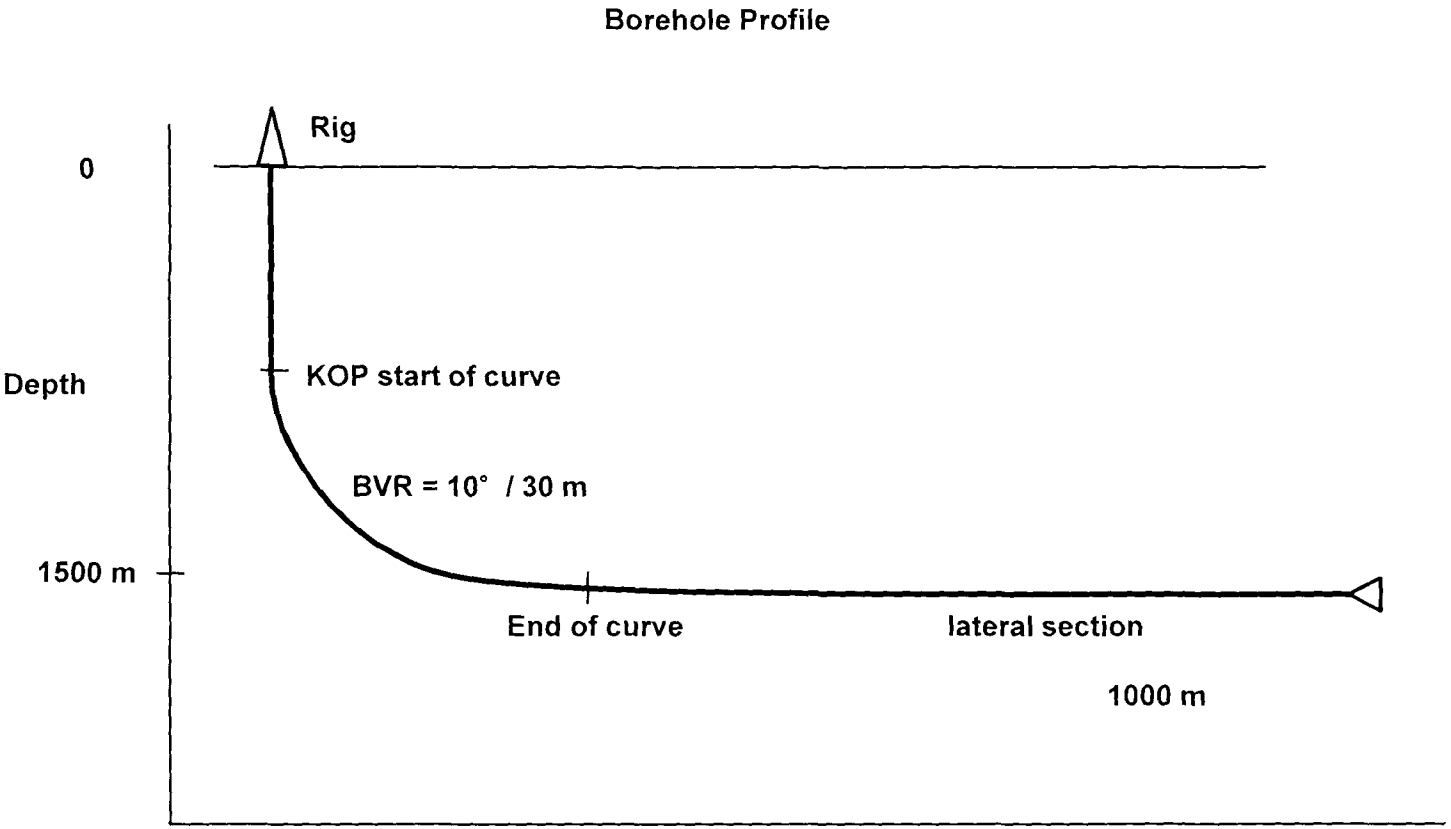
FIG. 1 is a diagram of an exemplary borehole profile including a vertical section, a lateral section, and a curve section connecting the vertical section and the lateral section, which may be drilled by a non-limiting implementation of the invention.

Referring to FIG. 1, an exemplary borehole profile includes a vertical section extending from a drilling rig at a surface location, a lateral section and a curve section. The curve section extends between a kickoff point (KOP) at the start of the curve section and an end of the curve. All or portions of the vertical section, the lateral section and/or the curve section may be drilled using the method of the invention.

Figure 2:
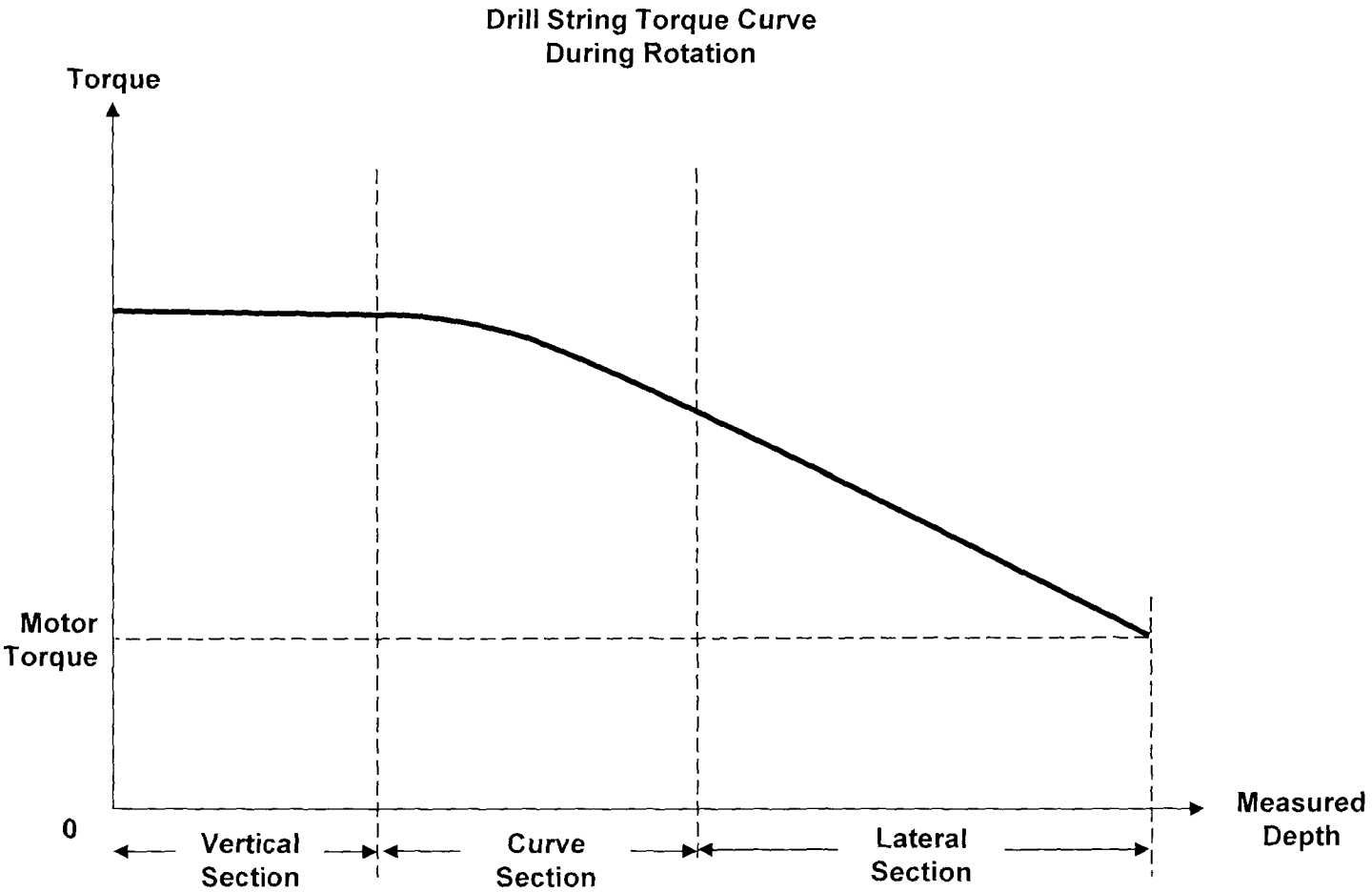
FIG. 2 is a graph of an exemplary drill string torque curve as a function of the length of a borehole, during simultaneous rotation of the drill string to the right to effect rotary drilling and operation of a downhole drilling motor to rotate the drill bit to the right, during performance of the rotary mode of a non-limiting implementation of the invention.

Referring to FIG. 2, an exemplary drill string torque curve is depicted during simultaneous rotation of the drill string to the right and operation of a downhole drilling motor to rotate the drill bit to the right, during performance of the rotary mode of a non-limiting implementation of the invention. A relatively high torque is present within the vertical section of the borehole due to the torque applied to the drill string to effect rotary mode drilling, which diminishes gradually through the curve section of the borehole and gradually through the lateral section of the borehole to a torque at the distal end of the drill string which is approximately equal to the torque applied to the drill bit by the drilling motor.

Figure 3:
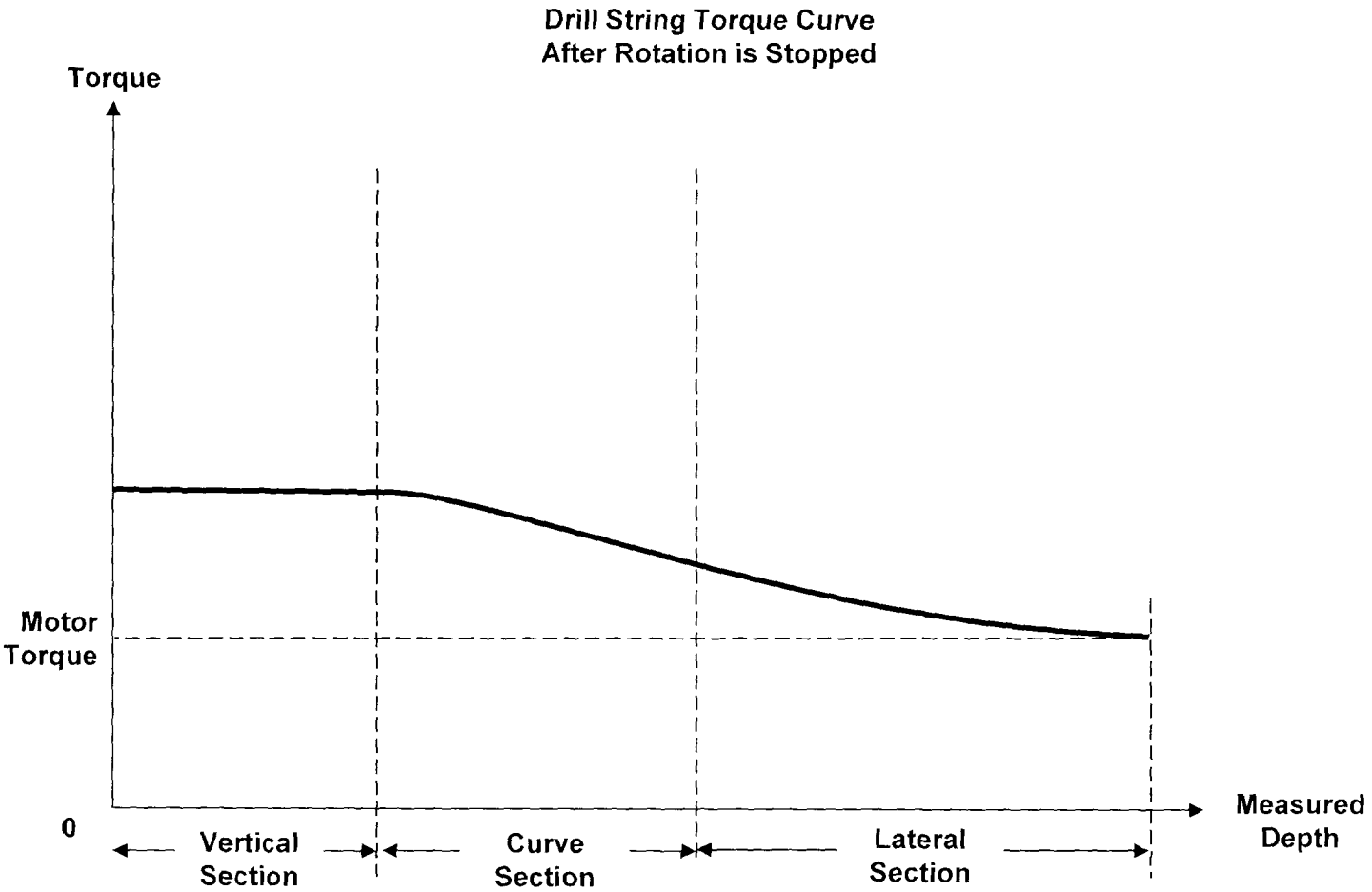
FIG. 3 is a graph of an exemplary drill string torque curve as a function of the length of a borehole, immediately after rotation of the drill string to the right has stopped, but while operation of the drilling motor continues, during performance of the directional mode of a non-limiting implementation of the invention.

Referring to FIG. 3, an exemplary drill string torque curve is depicted immediately after rotation of the drill string to the right has stopped, but while operation of the drilling motor continues, during performance of directional mode drilling in a non-limiting implementation of the invention. A relatively lower torque than in FIG. 2 is present within the vertical section of the borehole. The torque in the vertical section of the borehole is due to residual torque within the drill string following rotary mode drilling. The torque diminishes gradually through the curve section of the borehole and gradually through the lateral section of the borehole to a torque at the distal end of the drill string which is approximately equal to the torque applied to the drill bit by the drilling motor.

Figure 4:
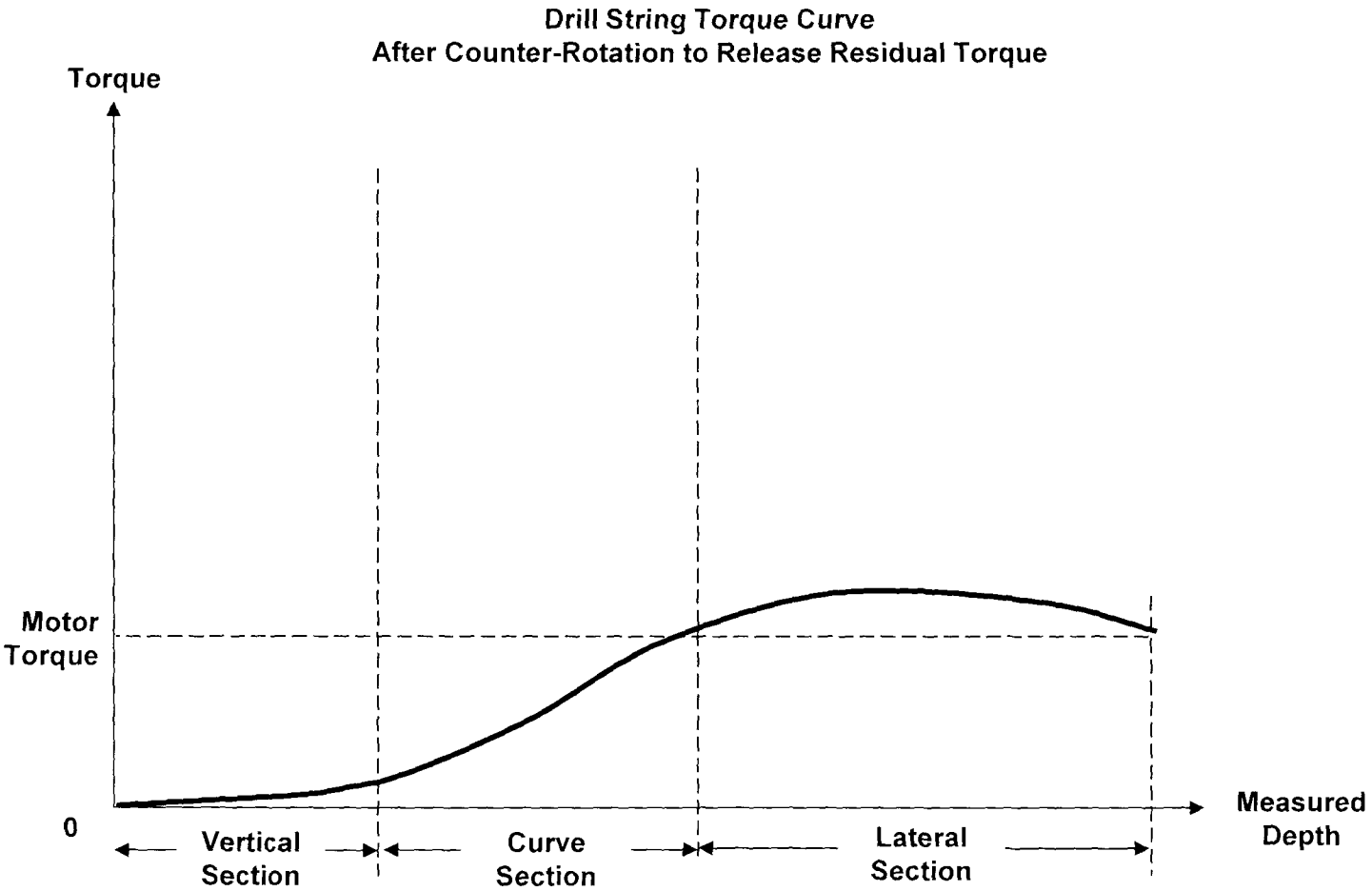
FIG. 4 is a graph of an exemplary drill string torque curve as a function of the length of a borehole following counter-rotation of the drill string to the left to release torque from the drill string resulting from rotary mode drilling as operation of the drilling motor continues, wherein the residual torque in the drill string at the surface location is approximately zero, during performance of the counter-rotation mode of a non-limiting implementation of the invention.

Referring to FIG. 4, an exemplary drill string torque curve is depicted after the drill string has been counter-rotated to the left from the surface location to release residual torque from the drill string, but while operation of the drilling motor continues, during performance of the counter-rotation mode of a non-limiting implementation of the invention. The torque in the vertical section of the borehole is approximately zero as a result of the counter-rotation of the drill string. The torque gradually increases through the curve section of the borehole to be approximately equal to the torque applied to the drill bit by the drilling motor. The torque in the lateral section of the borehole first continues to increase gradually and then diminishes gradually to a torque at the distal end of the drill string which is approximately equal to the torque applied to the drill bit by the drilling motor.

Figure 5:
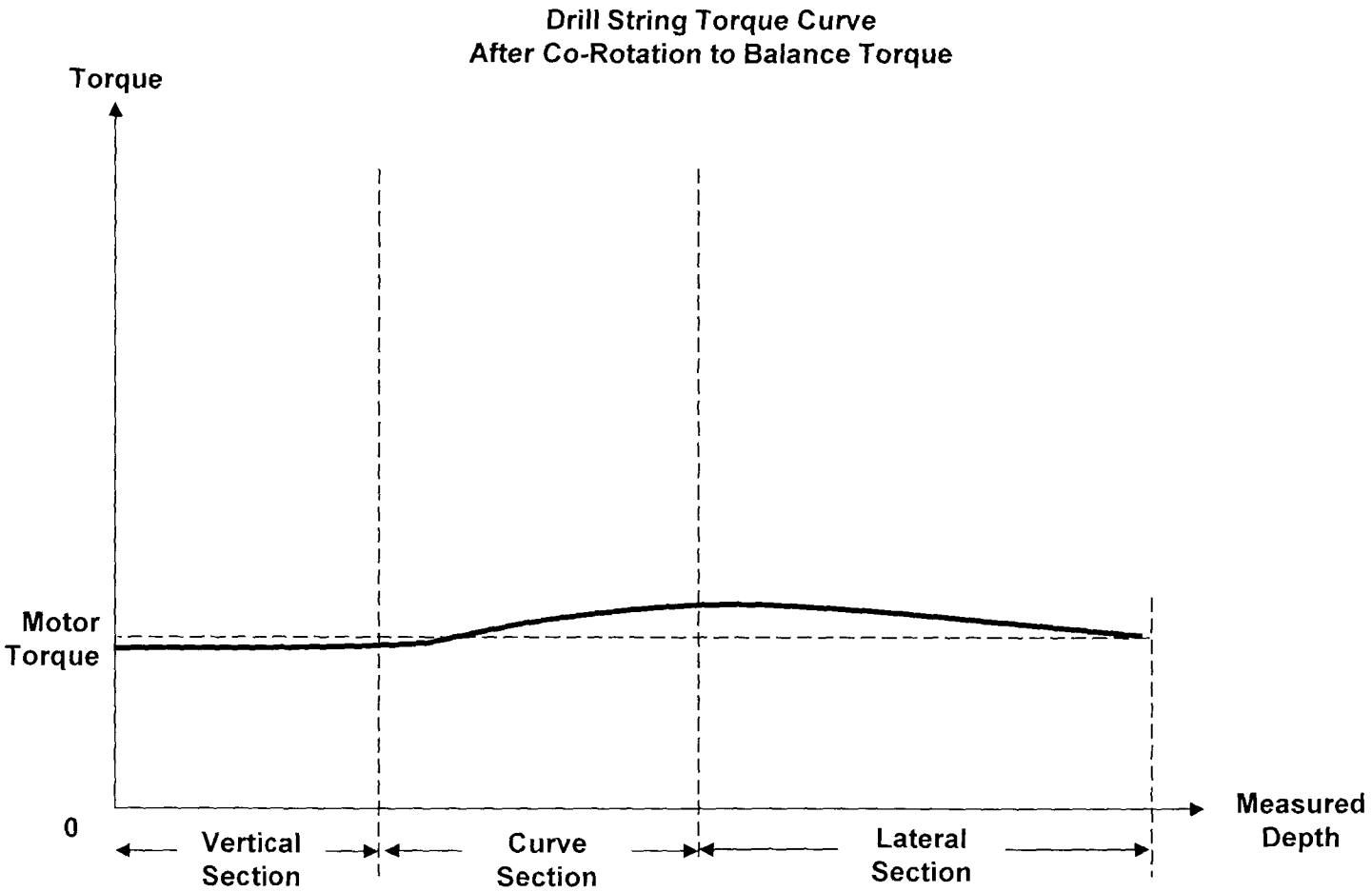
FIG. 5 is a graph of an exemplary drill string torque curve as a function of the length of a borehole following co-rotation of the drill string to the right to apply an amount of balance torque to the drill string from the surface location as operation of the drilling motor continues, wherein the balance torque in the drill string at the surface location is approximately equal to the torque generated by the drilling motor, during performance of the counter-rotation mode of a non-limiting implementation of the invention.

Referring to FIG. 5, an exemplary drill string torque curve is depicted after an amount of right-hand balance torque has been applied to the drill string at the surface location, but while operation of the drilling motor continues, during performance of the counter-rotation mode of a non-limiting implementation of the invention. The balance torque in the vertical section of the borehole is approximately equal to the torque applied to the drill bit by the drilling motor. The torque gradually increases through the curve section of the borehole and the lateral section of the borehole and then diminishes gradually in the lateral section to a torque at the distal end of the drill string which is approximately equal to the torque applied to the drill bit by the drilling motor.

Figure 6:
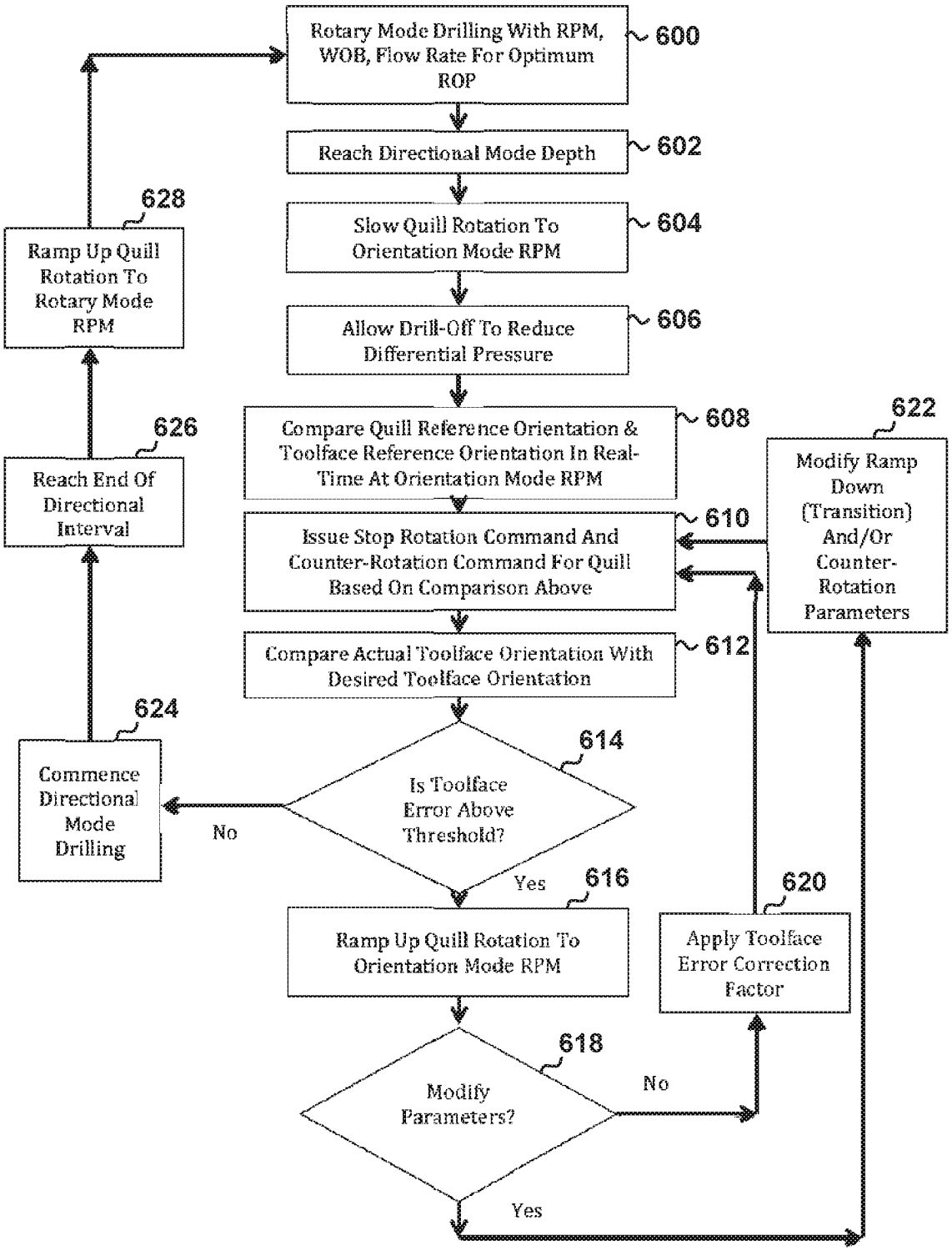
FIG. 6 is a flow chart of an exemplary drilling sequence in accordance with a non-limiting implementation of the invention.

Referring to FIG. 6, a flow chart of an exemplary drilling sequence in accordance with a non-limiting implementation of the invention is depicted.

Figure 7:
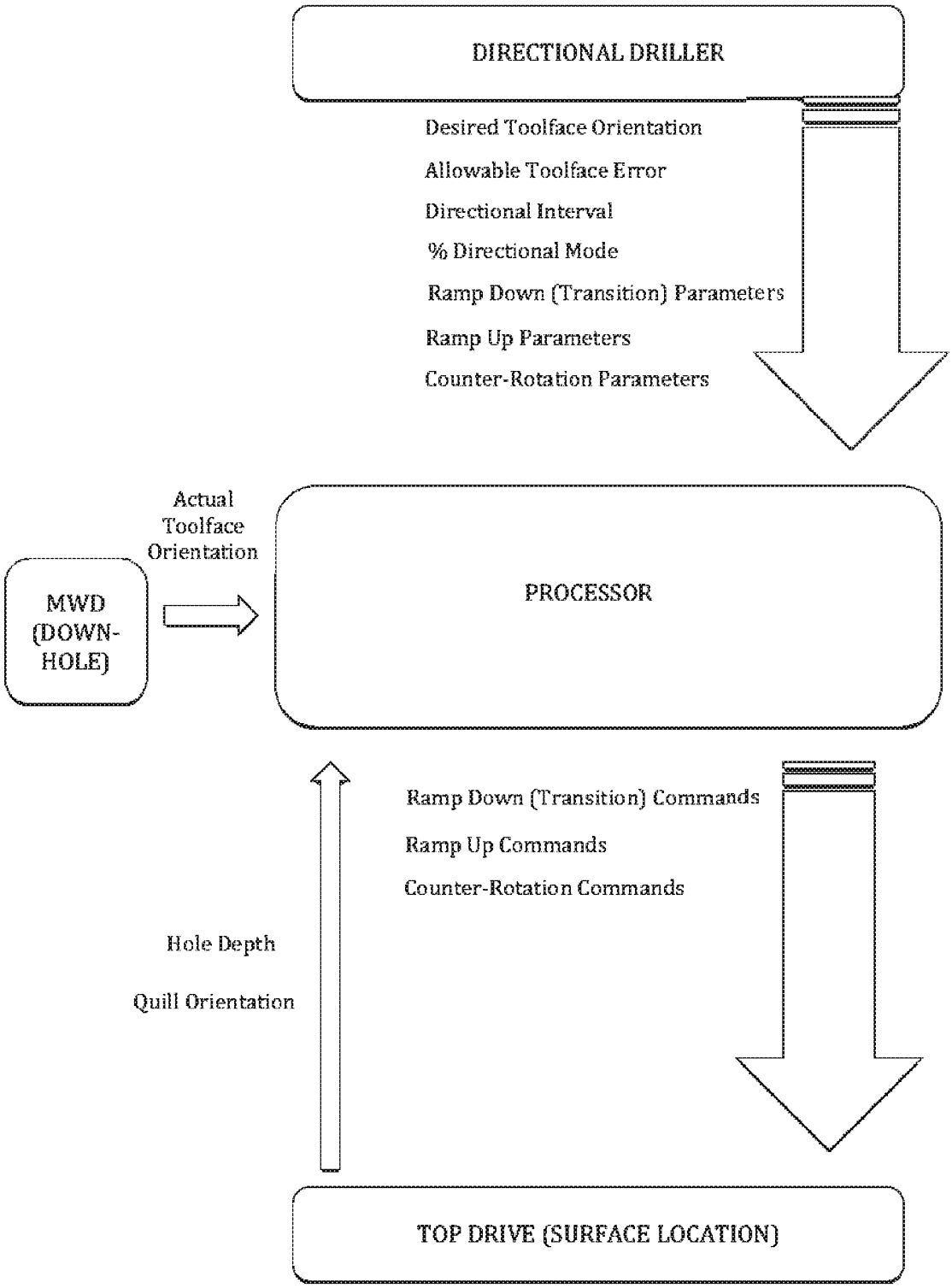
FIG. 7 is a flow chart of an exemplary data flow in accordance with a non-limiting implementation of the invention.

Referring to FIG. 7, a flow chart of an exemplary data flow in accordance with a non-limiting implementation of the invention is depicted.

Referring to FIG. 8, a table illustrating a hypothetical exemplary drilling sequence in accordance with a non-limiting implementation of the invention is provided.

Referring to FIG. 9, a table providing exemplary ranges for ramp down (transition) parameters during performance of the orientation mode and counter-rotation parameters during performance of the counter-rotation mode in accordance with a non-limiting implementation of the invention is provided.

Referring to FIG. 10, a table providing exemplary possible modifications to ramp down (transition) parameters during performance of the orientation mode and counter-rotation parameters during performance of the counter-rotation mode as consequences of possible events occurring during performance of the orientation mode and counter-rotation mode in accordance with a non-limiting implementation of the invention is provided.

FIGS. 1-10 are exemplary only. The features of the method and the system depicted in FIGS. 1-10 and described herein may be included in various combinations and sub-combinations in alternate methods and systems.

More particularly, the method of the invention may be performed using any suitable apparatus or any suitable combination of apparatus, including but not limited to an exemplary system comprising some or all of the following apparatus.

In the exemplary system embodiment, a surface apparatus at the surface location may comprise an encoder which transmits real-time surface orientation data to a surface computer with respect to the surface orientation of the drill string. The "surface orientation" of the drill string is the angular orientation of a reference position adjacent or at a proximal end of the drill string.

The surface orientation of the drill string may be indicated by a rotating part of a rotary drive, by a top drive "quill" orientation, by a rotary table orientation, or by any other orientation which relates to the orientation of the drill string at the surface location.

In the exemplary system embodiment, the surface apparatus may comprise a top drive equipped with an encoder which transmits real-time encoder data to a surface computer relating to a top drive quill orientation. In some applications, the top drive may have the ability to follow commands from the surface computer to rotate and stop the drill string at a particular angular orientation.

In the exemplary system embodiment, the surface computer may have an onboard timing clock (synchronized with downhole instruments) to read top drive encoder orientations at preset time intervals. The surface computer may also have the ability to receive data (including toolface orientation data) from downhole instruments such as a measurement while drilling (MWD) tool.

In the exemplary system embodiment, a downhole apparatus may comprise a downhole computer with a timing clock synchronized with the surface computer.

In the exemplary system embodiment, the downhole computer may be capable of obtaining downhole toolface orientation data at precise time intervals coincident with the surface computer obtaining top drive encoder orientation data. In the exemplary system embodiment, the downhole computer may be capable of reading, storing and averaging toolface orientation data over a defined period of time and may be capable of commanding a conventional MWD tool to transmit the toolface orientation data to the surface location.

The "toolface orientation" is the angular orientation of a reference position adjacent to the distal end of the drill string. The toolface orientation may be indicated by the orientation of a bend in a bent motor or bent sub or by any other suitable reference position adjacent to the distal end of the drill string.

In general, the downhole computer and the surface computer are collectively a computer that comprises a processor that is capable of reading a set of instructions stored in a non-transitory storage media, to cause the processor and any operatively connected components (such as an encoder, a rotary drive such as a top drive, and a downhole instrument such as a MWD tool) to perform one or more steps embodying to implement a desired functionality. The computer may be located at the surface, or in the downhole environment, or a combination of the surface and the downhole environment. As such, it will be understood that references in this document to the "downhole computer" and to the "surface computer" do not limit the invention in respect to the location of the computer. Further, the computer or portions thereof may be located remotely from the borehole site.

The exemplary embodiment of the method may include the following.

In the exemplary method embodiment, the surface computer may command the top drive to rotate the drill string at a rotation mode rotation rate in the rotary mode (FIG. 6, step 600). The rotation mode rotation rate, the weight-on-bit (WOB), and flow rate of the drilling fluid may be selected to optimize for the rate-of-penetration (ROP).

In the exemplary method embodiment, upon the drill bit reaching a directional mode depth (FIG. 6, step 602), the surface computer may command the top drive to rotate the drill string at an orientation mode rotation rate (such as exactly 20 revolutions per minute (rpm)) (FIG. 6, step 604) in an orientation mode while the top drive encoder sends top drive quill orientation data coincident with the timing clock at T+3 second intervals to the surface computer. Thus the top drive should confirm rotation of 20 rpm by transmitting exactly the same top drive quill orientation (in degrees) every 3 seconds (i.e., the time required for a single rotation of the drill string at 20 rpm), The top drive quill orientation during the orientation mode may represent a "surface reference orientation" of the drill string.

In the exemplary method embodiment, the downhole computer may optionally be configured to recognize the orientation mode of rotation of the drill string from the surface location (such as 20 rpm) because of a downhole accelerometer package of a MWD tool, and in response may obtain instantaneous actual toolface orientation data at intervals (such as T+3 second intervals), coincident with the transmission of the top drive quill orientation data from the top drive to the surface computer. Further, the downhole computer may optionally command the MWD tool to transmit the toolface orientation data to the surface computer, which may represent a "toolface reference orientation" at or adjacent to the distal end of the drill string.

In the exemplary method embodiment, the downhole computer may optionally calculate an average toolface orientation from instantaneous actual toolface orientation data obtained at intervals (such as T+3 second intervals) over a time period (such as 1 minute), coincident with the transmission of the top drive quill orientation data from the top drive to the surface computer, and may command the MWD tool to transmit the average toolface orientation to the surface computer, which may represent a toolface reference orientation at or adjacent to the distal end of the drill string.

In the exemplary method embodiment, the downhole computer may optionally be configured to obtain instantaneous actual toolface orientation data in response to any rotation rate of the drill string or within a range of rotation rates of the drill string, coincident with the transmission of the top drive quill orientation data from the top drive to the surface computer, and may command the MWD tool to transmit a toolface orientation and/or an average toolface orientation to the surface location, which may represent a toolface reference orientation of the distal end of the drill string.

In the exemplary method embodiment, the orientation mode may be continued for a length of time which is sufficient to enable the rotation of the drill string to achieve a relatively steady state in which the relationship between the surface reference orientation and the toolface reference orientation is relatively constant.

In the exemplary method embodiment, a desired differential pressure of a fluid circulating through the drill string may be achieved (FIG. 6, step 606) before transitioning the rotation of the drill string from the orientation mode rotation rate to the surface stop orientation, as discussed below. In some applications, this may be achieved by the surface computer allowing drill-off of the drill string while rotating the drill string at the orientation mode rotation rate.

The surface computer may optionally determine a relationship between the toolface reference orientation and the surface reference orientation (FIG. 6, step 608; and FIG. 8, "Delta (Quill) to Desired Toolface")). In many applications of the method, it may not be necessary to obtain the reference orientations and/or determine the relationship between the reference orientations.

The surface computer may optionally direct the top drive to stop the rotation of the drill string at a "surface stop orientation" of the top drive quill which may be predicted to provide a desired toolface stop orientation, based upon the determined relationship between the toolface reference orientation and the surface reference orientation (FIG. 6, step 610). When the surface orientation of the drill string is at the surface stop orientation, the toolface orientation is at a toolface stop orientation.

In the exemplary method embodiment, the command from the surface computer to the top drive to stop rotation may be in accordance with ramp down (transition) parameters which specify the manner and rate at which the drill string decelerates from the orientation mode rotation rate (such as 20 rpm) and stops at the surface stop orientation (FIG. 9, "Ramp Down (Transition) Parameters"). The ramp down (transition) parameters for similar drilling conditions may in many applications of the method be consistent to increase the likelihood that each stop command may provide a consistent result with respect to the actual toolface orientation which is achieved. Ramp down (transition) parameters may comprise, without limitation, one or more parameters such as degrees of rotation to the surface stop orientation, time of rotation to the surface stop orientation, the deceleration curve of the drill string to the surface stop orientation, etc.

The method may optionally include implementing the counter-rotation mode to move the surface orientation of the drill string from the surface stop position to a "surface fixed orientation" in order to release torque from the drill string and/or balance torque within the drill string, which torque may otherwise result in unwanted rotation of the drill string and the toolface orientation as the directional mode progresses during the following directional interval.

After the drill string is stopped at the surface stop orientation, the counter-rotation mode may be implemented (FIG. 6, step 610). The counter-rotation mode may be performed by counter-rotating the drill string from the surface location to release torque and/or by co-rotating the drill string from the surface location to provide a balance torque in the drill string at the surface location. At the completion of the counter-rotation mode, the drill string will be stopped at a "surface fixed orientation", which may be the same as or different from the surface stop orientation. At the completion of the counter-rotation mode, the toolface orientation will be at a toolface fixed orientation, which may be the same as or different from the toolface stop orientation.

The counter-rotation mode may be performed in a manner so that the toolface orientation does not change as the surface orientation moves from the surface stop orientation to the surface fixed orientation. Alternatively, a predicted movement of the toolface orientation in the counter-rotation mode may be accounted for in performing the orientation mode so that an amount of movement of the toolface orientation during the counter-rotation mode does not result in an unacceptable error in the toolface orientation in comparison with a desired toolface fixed orientation range when the surface orientation is at the surface fixed orientation.

In applications of the method in which the counter-rotation mode is not implemented, the surface fixed orientation may be the same as the surface stop orientation, and the toolface fixed orientation may be the same as the toolface stop orientation.

After rotation of the drill string has stopped following the orientation mode, the MWD tool may transmit the toolface stop orientation to the surface computer and the toolface stop orientation may be compared with a desired toolface stop orientation (FIG. 6, step 612). The desired toolface stop orientation, the toolface stop orientation and the surface stop orientation may be compared to determine a relationship between the surface stop orientation and the toolface stop orientation, and/or a relationship amongst the surface stop orientation, the toolface stop orientation, and the desired toolface stop orientation.

If an unacceptable amount of error exists between the desired toolface stop orientation and the toolface stop orientation (FIG. 6, step 614), then the surface computer may command the top drive to restart the orientation mode (FIG. 6, step 616) and to stop rotation of the drill string at a new surface stop orientation which applies a correction factor (FIG. 6, step 620; FIG. 8. "Toolface Error") to the previous surface stop orientation, to account for the difference between the previous toolface stop orientation and the desired toolface stop orientation.

Alternatively or additionally, if an unacceptable amount of error exists between the desired stop toolface orientation and the toolface stop orientation (FIG. 6, step 614), then the surface computer may command the top drive to restart the orientation mode (FIG. 6, step 616) and to stop rotation of the drill string at a new surface stop orientation in accordance with the ramp down (transition) parameters which are modified taking into account the difference between the previous toolface stop orientation and the desired toolface stop orientation (FIG. 6, step 622; and FIG. 10).

In applications of the method in which the counter-rotation mode is implemented, the surface fixed orientation may be different from the surface stop orientation, and the toolface fixed orientation may be different from the toolface stop orientation.

After rotation of the drill string has stopped following the counter-rotation mode, the MWD tool may transmit the toolface fixed orientation to the surface computer and the toolface fixed orientation may be compared with a desired toolface fixed orientation (FIG. 6, step 612). The desired toolface fixed orientation, the toolface fixed orientation and the surface fixed orientation may be compared to determine a relationship between the surface fixed orientation and the toolface fixed orientation, and/or a relationship amongst the surface fixed orientation, the toolface fixed orientation, and the desired toolface fixed orientation.

If an unacceptable amount of error exists between the desired toolface fixed orientation and the toolface fixed orientation (FIG. 6, step 614), then the surface computer may command the top drive to restart the orientation mode (FIG. 6, step 616) and to stop rotation of the drill string at a new surface stop orientation which applies a correction factor (FIG. 6, step 620; FIG. 8, "Toolface Error") to the previous surface stop orientation, to account for the difference between the previous toolface fixed orientation and the desired toolface fixed orientation.

Alternatively or additionally, if an unacceptable amount of error exists between the desired fixed toolface orientation and the toolface fixed orientation (FIG. 6, step 614), then the surface computer may command the top drive to restart the orientation mode (FIG. 6, step 616) and to stop rotation of the drill string at a new surface stop orientation in accordance with the ramp down (transition) parameters which are modified taking into account the difference between the previous toolface fixed orientation and the desired toolface fixed orientation (FIG. 6, step 622; and FIG. 10).

Alternatively or additionally, if an unacceptable amount of error exists between the desired toolface fixed orientation and the toolface fixed orientation (FIG. 6, step 614), then the surface computer may modify the counter-rotation parameters to take into account the difference between the previous toolface fixed orientation and the desired toolface fixed orientation (FIG. 6, step 622; and FIG. 10), before repeating the counter-rotating mode.

The process of repeating the orientation mode and/or repeating the counter-rotation mode (FIG. 6, step 616) and stopping rotation of the drill string at a new surface stop orientation may be continued until the desired toolface stop orientation or the desired toolface fixed orientation, as the case may be, has been achieved within an acceptable range representing an acceptable error threshold.

The orientation mode may therefore be performed following either the rotary mode or the directional mode. If the orientation mode follows the rotary mode, the purpose of performing the orientation mode may be to provide a transition between the rotary mode and the directional mode. If the orientation mode follows the directional mode, the purpose of performing the orientation mode may be to adjust the actual toolface orientation during a directional interval or to provide weight to the drill bit during a directional interval by overcoming static friction in the drill string.

After completion of the directional mode to drill a directional interval of the borehole (FIG. 6, steps 624 and 626), the method may transition to the rotary mode to drill a rotary interval, in which the drill string is rotated at a rotary mode rotation rate. The transition from the directional mode to the rotary mode may be performed in accordance with ramp up (transition) parameters (FIG. 6, step 628). Ramp up (transition) parameters may comprise, without limitation, one or more parameters such as target rotary mode rotation rate, degrees of rotation to achieve the target rotary mode rotation rate, time of rotation to achieve the target rotary mode rotation rate, the acceleration curve of the drill string to achieve the rotary mode rotation rate, etc. In the exemplary method embodiment, the target rotary mode rotation rate, along with the weight-on-bit (WOB) and flow rate of drilling fluid, may be selected to provide an optimum rate of penetration (ROP) or to otherwise optimize drilling during the rotary interval.

In the exemplary method embodiment, the rotary mode, the orientation mode, the directional mode and the counter-rotating mode may be repeated one or more times in order to drill all or a portion of a borehole.

The invention may potentially provide a number of benefits.

A first potential benefit of the invention is that since there is minimal delay in transitioning between rotary drilling and non-rotary drilling, lost rig time is minimized and it becomes more feasible to implement numerous rotary intervals and directional intervals for each 9 meter joint of drill pipe which is added to the drill string, potentially resulting in the production of a smoother borehole, which in turn could potentially allow a longer lateral section to be drilled following a curve section.

A second potential benefit of the invention is that problems associated with providing weight to the drill bit may be reduced. If drill-off is detected and static friction cannot be overcome then a short rotary interval may be initiated to transfer weight to the drill bit and then a directional interval can be resumed, potentially resulting in higher average rates of penetration during drilling.

As indicated above, in many applications of the method, it may not be necessary to obtain the reference orientations and/or to compare the reference orientations. As a result, in many applications, the method of the invention may be performed without use of timing clocks and/or comparison of reference orientations.

Example 1

In a first example, the method of the invention may be performed as follows in order to drill a 9 meter length of borehole:

1. the driller decides to drill a 9 meter curve section of borehole using the method of the invention;
2. decisions are made with respect to the percentage of the curve section which will be drilled in rotary mode (the "rotary period"), the percentage of the curve section which will be drilled in directional mode (the "directional period"), the number and length of each rotary interval, and the number and length of each directional interval. These decisions may be based on many parameters including, but not limited to, knowledge of the underground formations present, the progress of the borehole path thus far, the amount of bend in the downhole motor, the type of borehole and its intended use, etc.;
3. the driller inputs into the surface computer the rotary period and the directional period (FIG. 7, "Directional Driller");
4. the driller inputs into the surface computer the length of the rotary interval(s) and the directional interval(s) in one meter increments (FIG. 7, "Directional Driller");
5. the driller enters into the surface computer the desired toolface stop orientation and allowable toolface error for each directional interval (FIG. 7, "Directional Driller");
6. the driller enters into the surface computer ramp down (transition) parameters for a stop command (e.g., stop from 20 rpm at a constant deceleration rate deceleration or an exponential deceleration rate, within a specified number of degrees of top drive quill rotation and/or in a specified number of seconds) (FIG. 7, "Directional Driller");

7. the driller enters into the surface computer ramp up (transition) parameters to start rotary mode drilling (e.g., ramp up to 45 rpm in 10 sec at a constant acceleration rate or exponential acceleration rate, within a specified number of degrees of top drive quill rotation and/or in a specified number of seconds) (FIG. 7, "Directional Driller");
8. the surface computer commands the top drive to initiate the rotary mode of drilling in accordance with the specified ramp up (transition) parameters;
9. the driller manually adjusts weight on bit, fluid flow rate, and the rotary mode rotation rate to optimize drilling during the rotary mode;
10. the surface computer senses feedback on depth indicating the end of a rotary interval;
11. the surface computer initiates a command to the top drive to reduce the rotation rate of the drill string to the orientation mode orientation rate (e.g., 20 rpm) to begin the orientation mode;
12. the driller allows weight to drill-off in the orientation mode in order to achieve a desired differential pressure through the drill string (e.g., 200 psi);
13. the downhole computer senses the orientation mode and obtains, records and averages the toolface reference orientation and transmits the toolface orientation data to the surface computer;
14. the surface computer compares the actual toolface orientation to the desired toolface stop orientation and commands the rotation of the drill string to stop from the orientation mode rotation rate in accordance with the specified ramp down (transition) parameters with the goal of achieving the desired toolface stop orientation;
15. the counter-rotation mode is implemented by counter-rotating the drill string from the surface location and possibly co-rotating the drill string from the surface location, so that the surface orientation of the drill string moves from a surface stop orientation to a surface fixed orientation;
16. the toolface fixed orientation after the rotation of the drill string has stopped is obtained by the downhole computer and transmitted to the surface computer;
17. if the toolface fixed orientation is outside of a desired toolface fixed orientation range and is thus unacceptable, then the orientation mode is repeated using a correction factor representing the difference between the toolface fixed orientation and a desired toolface fixed orientation within a desired toolface fixed orientation range. In some circumstances, before the orientation mode is repeated, the ramp down (transition) parameters and/or the counter-rotation parameters may be modified in addition to or in substitution for the use of a correction factor;
18. if the toolface fixed orientation is within the desired toolface fixed orientation range and is thus acceptable, then the directional mode of drilling is performed for the directional interval;
19. when the directional interval is completed, the surface computer commands the top drive to transition to the rotary mode of drilling in accordance with the ramp up (transition) parameters; and
20. the above sequence is repeated until the 9 meter curve section is completed.

Example 2

In a second example, the method of the invention may be performed as follows in order to drill a desired length of borehole:

1. the top drive quill orientation is reset to 0 degrees coincident with a mark (such as a chalk line scribe) marked on the drill string for visual reference;
2. the rotary mode of drilling is performed for a rotary interval while rotating the drill string at a rotary mode rotation rate;
3. at the completion of the rotary interval, rotation of the drill string is reduced to the orientation mode rotation rate (e.g., 20 rpm);
4. weight is drilled-off until a desired differential pressure through the drill string (e.g., 200 psi) is achieved;
5. the surface computer commands the top drive to stop rotation of the drill string from the orientation mode rotation rate at the surface stop orientation in accordance with selected ramp down (transition) parameters;
6. the drill string is counter-rotated from the surface stop orientation to the left by 450 degrees (1.25 revolutions) and to the right by 270 degrees (0.75 revolutions) to the surface fixed orientation, and the top drive brake is applied to maintain the surface orientation of the drill string at the surface fixed orientation;
7. the desired differential pressure through the drill string (e.g., 200 psi) is maintained;
8. the directional interval is drilled in directional mode of drilling, with the drill string held at the surface fixed orientation at the surface location;
9. when the directional interval is completed, the computer commands the top drive to transition to the rotary mode of drilling in accordance with selected ramp up (transition) parameters; and
10. the above sequence is repeated until the desired length of borehole is drilled using the method.

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The invention claimed is:

1. A method of drilling a borehole from a surface location with a drill string comprising a surface end having a surface orientation and a distal end having a toolface orientation, the method comprising:

(a) a rotary mode comprising rotating the drill string at a rotary mode rotation rate in order to drill the borehole for a rotary interval;

(b) an orientation mode comprising:

(i) rotating the drill string at an orientation mode rotation rate;

(ii) transitioning the rotation of the drill string from the orientation mode rotation rate to a non-rotating state in which the surface orientation is at a surface stop orientation, wherein the transitioning is performed in accordance with a plurality of ramp down transition parameters which specify the manner and rate at which the drill string decelerates from the orientation mode rotation rate to the non-rotating state; and (c) a directional mode comprising maintaining the surface orientation at a surface fixed orientation in order to drill the borehole for a directional interval.

2. The method as claimed in claim 1, further comprising repeating any one or a combination of the rotary mode, the orientation mode and the directional mode one or more times in order to drill the borehole with alternating rotary intervals and directional intervals.

3. The method as claimed in claim 1 wherein the rotary mode, the orientation mode and the directional mode are implemented within a length of a single joint of drill pipe added to the drill string.

4. The method as claimed in claim 1 wherein the rotary mode rotation rate is the same as the orientation mode rotation rate, such that rotating the drilling string at the orientation mode rotation rate is performed while rotating the drill string at the rotary mode rotation rate.

5. The method as claimed in claim 1 wherein the surface stop orientation is the same as the surface fixed orientation.

6. The method as claimed in claim 1, further comprising a counter-rotation mode comprising either counter-rotating or co-rotating, or both counter-rotating and co-rotating the drill string from the surface stop orientation to the surface fixed orientation.

7. The method as claimed in claim 6, wherein the counter-rotation mode is performed in order to release torque from the drill string.

8. The method as claimed in claim 7 wherein torque is released from the drill string to achieve a desired residual torque in the drill string at the surface location.

9. The method as claimed in claim 6, wherein the counter-rotation mode is performed in order to achieve a desired balance torque along the length of the drill string.

10. The method as claimed in claim 9 wherein the desired balance torque is approximately equal to an expected torque in the drill string during the directional mode.

11. The method as claimed in claim 6 wherein the toolface orientation is at a toolface fixed orientation when the surface orientation is at the surface fixed orientation, and wherein the surface stop orientation takes into account a predicted relationship between the surface fixed orientation and the toolface fixed orientation such that the surface fixed orientation following the counter-rotation mode is predicted to result in the toolface orientation being within a desired toolface fixed orientation range.

12. The method as claimed in claim 6 wherein the toolface orientation is at a toolface fixed orientation when the surface orientation is at the surface fixed orientation, further comprising repeating the counter-rotation mode if the toolface fixed orientation is not within a desired toolface fixed orientation range.

13. The method as claimed in claim 12 wherein the counter-rotation mode is performed in accordance with at least one selected counter-rotation parameter, further comprising modifying the at least one selected counter-rotation parameter if the toolface fixed orientation is not within the desired toolface fixed orientation range, before repeating the counter-rotation mode, wherein the at least one selected counter-rotation parameter is modified based upon a difference between the toolface fixed orientation and the desired toolface fixed orientation range.

14. The method as claimed in claim 1 wherein the toolface orientation is at a toolface stop orientation when the surface orientation is at the surface stop orientation and wherein the surface stop orientation is selected based on a predicted relationship between the surface stop orientation and the toolface stop orientation.

15. The method as claimed in claim 1, further comprising achieving a desired differential pressure of a fluid circulating through the drill string before transitioning the rotation of the drill string from the orientation mode rotation rate to the non-rotating state.

16. The method as claimed in claim 15 wherein the desired differential pressure is achieved by allowing drill-off of the drill string while rotating the drill string at the orientation mode rotation rate.

17. The method as claimed in claim 1 wherein the toolface orientation is at a toolface stop orientation when the surface orientation is at the surface stop orientation, further comprising repeating the orientation mode if the toolface stop orientation is not within a desired toolface stop orientation range.

18. The method as claimed in claim 17, further comprising applying a correction factor to the surface stop orientation, before repeating transitioning the rotation of the drill string to the orientation mode rotation rate to the non-rotating state, wherein the correction factor is selected based upon a difference between the toolface stop orientation and the desired toolface stop orientation range.

19. The method as claimed in claim 1 wherein the toolface orientation is at a toolface stop orientation when the surface orientation is at the surface stop orientation, further comprising repeating the orientation mode if the toolface stop orientation is not within a desired toolface stop orientation range, and modifying at least one of the ramp down transition parameters if the toolface stop orientation is not within the desired toolface stop orientation range, before repeating transitioning the rotation of the drill string from the orientation mode rotation rate to the non-rotating state, wherein the at least one ramp down transition parameter is modified based upon a difference between the toolface stop orientation and the desired toolface stop orientation range.

20. The method as claimed in claim 1 wherein, as the drill string is rotated at the orientation mode rotation rate in the orientation mode, the surface orientation has a surface reference orientation and the toolface orientation has a toolface reference orientation, further comprising determining a relationship between the toolface reference orientation and the surface reference orientation, wherein the surface stop orientation is selected based on the relationship.

21. The method as claimed in claim 20 wherein the surface reference orientation and the toolface reference orientation are determined at a plurality of coincident time intervals over a time period.

22. The method as claimed in claim 21 wherein the surface reference orientation and the toolface reference orientation are averaged over the time period.

23. The method as claimed in claim 1 wherein each of the plurality of ramp down transition parameters is selected from the group of parameters consisting of a number of degrees of rotation to the non-rotating state, a time of rotation to the non-rotating state, and a deceleration curve to the non-rotating state.

24. A system for drilling a borehole from a surface location with a drill string, for use with an encoder for transmitting surface orientation data indicative of a surface orientation of a surface end of the drill string, a downhole instrument for transmitting toolface orientation data indicative of a toolface orientation of a distal end of the drill string, and a rotary drive for rotating the drill string, the system comprising:

(a) a processor operatively connected to the encoder to receive the surface orientation data, to the downhole instrument to receive the toolface orientation data, and to the rotary drive to control rotation of the drill string;

(b) a non-transitory storage medium having instructions stored thereon, wherein the processor is configured to read the instructions, and wherein the instructions cause the processor to implement a method comprising:

(i) a rotary mode comprising rotating the drill string at a rotary mode rotation rate in order to drill the borehole for a rotary interval;

(ii) an orientation mode comprising:

(A) rotating the drill string at an orientation mode rotation rate;

(B) transitioning the rotation of the drill string from the orientation mode rotation rate to a non-rotating state in which the surface orientation is at a surface stop orientation, wherein the transitioning is performed in accordance with a plurality of ramp down transition parameters which specify the manner and rate at which the drill string decelerates from the orientation mode rotation rate to the non-rotating state; and (iii) a directional mode comprising maintaining the surface orientation at a surface fixed orientation in order to drill the borehole for a directional interval.

25. The system as claimed in claim 24, the method further comprising repeating any one or a combination of the rotary mode, the orientation mode and the directional mode one or more times in order to drill the borehole with alternating rotary intervals and directional intervals.

26. The system as claimed in claim 24 wherein the rotary mode, the orientation mode and the directional mode are implemented within a length of a single joint of drill pipe added to the drill string.

27. The system as claimed in claim 24 wherein the rotary mode rotation rate is the same as the orientation mode rotation rate, such that rotating the drilling string at the orientation mode rotation rate is performed while rotating the drill string at the rotary mode rotation rate.

28. The system as claimed in claim 24 wherein the surface stop orientation is the same as the surface fixed orientation.

29. The system as claimed in claim 24, the method further comprising a counter-rotation mode comprising either counter-rotating or co-rotating, or both counter-rotating and co-rotating the drill string from the surface stop orientation to the surface fixed orientation.

30. The system as claimed in claim 29 wherein the counter-rotation mode is performed in order to release torque from the drill string.

31. The system as claimed in claim 30 wherein the torque is released from the drill string to achieve a desired residual torque in the drill string at the surface location.

32. The system as claimed in claim 29, wherein the counter-rotation mode is performed in order to achieve a desired balance torque along the length of the drill string.

33. The system as claimed in claim 32 wherein the desired balance torque is approximately equal to an expected torque in the drill string during the directional mode.

34. The system as claimed in claim 29 wherein the toolface orientation is at a toolface fixed orientation when the surface orientation is at the surface fixed orientation, and wherein the surface stop orientation takes into account a predicted relationship between the surface fixed orientation and the toolface fixed orientation such that the surface fixed orientation following the counter-rotation mode is predicted to result in the toolface orientation being within a desired toolface fixed orientation range.

35. The system as claimed in claim 29 wherein the toolface orientation is at a toolface fixed orientation when the surface orientation is at the surface fixed orientation, further comprising repeating the counter-rotation mode if the toolface fixed orientation is not within a desired toolface fixed orientation range.

36. The system as claimed in claim 35 wherein the counter-rotation mode is performed in accordance with at least one selected counter-rotation parameter, further comprising modifying the at least one selected counter-rotation parameter if the toolface fixed orientation is not within the desired toolface fixed orientation range, before repeating the counter-rotation mode, wherein the at least one selected counter-rotation parameter is modified based upon a difference between the toolface fixed orientation and the desired toolface fixed orientation range.

37. The system as claimed in claim 36, further comprising applying a correction factor to the surface stop orientation, before repeating transitioning the rotation of the drill string to the orientation mode rotation rate to the non-rotating state, wherein the correction factor is selected based upon a difference between the toolface stop orientation and the desired toolface stop orientation range.

38. The system as claimed in claim 24 wherein the toolface orientation is at a toolface stop orientation when the surface orientation is at the surface stop orientation, further comprising repeating the orientation mode if the toolface stop orientation is not within a desired toolface stop orientation range.

39. The system as claimed in claim 24 wherein the toolface orientation is at a toolface stop orientation when the surface orientation is at the surface stop orientation, further comprising repeating the orientation mode if the toolface stop orientation is not within a desired toolface stop orientation range, and modifying at least one of the ramp down transition parameters if the toolface stop orientation is not within the desired toolface stop orientation range, before repeating transitioning the rotation of the drill string from the orientation mode rotation rate to the non-rotating state, wherein the at least one ramp down transition parameter is modified based upon a difference between the toolface stop orientation and the desired toolface stop orientation range.

40. The system as claimed in claim 24 wherein, as the drill string is rotated at the orientation mode rotation rate in the orientation mode, the surface orientation has a surface reference orientation and the toolface orientation has a toolface reference orientation, the method further comprising determining a relationship between the toolface reference orientation and the surface reference orientation, wherein the surface stop orientation is selected based on the relationship.

41. The system as claimed in claim 40 wherein the computer comprises at least one timing clock, and the surface reference orientation and the toolface reference orientation are determined at a plurality of coincident time intervals set by the at least one timing clock over a time period.

42. The system as claimed in claim 41 wherein the surface reference orientation and the toolface reference orientation are averaged over the time period.

43. The system as claimed in claim 24 wherein each of the plurality of ramp down transition parameters is selected from the group of parameters consisting of a number of degrees of rotation to the non-rotating state, a time of rotation to the non-rotating state, and a deceleration curve to the non-rotating state.

* * * * *